US005819578A

United States Patent [19]

Codatto

[11] Patent Number: 5,819,578

[45] Date of Patent: Oct. 13, 1998

[54] PROCESS AND APPARTUS FOR PRODUCING REINFORCEMENT PROFILES ON SHEET METAL PANELS

[75] Inventor: Antonio Codatto, Vicenza, Italy

[73] Assignee: Sapim Amada S.p.A., Lonigo, Italy

[21] Appl. No.: 618,598

[22] Filed: Mar. 20, 1996

[30] Foreign Application Priority Data

Mar. 23, 1995 [IT] Italy ..... VI95 A 0046

[51] Int. Cl.[6] ..... B21D 05/01

[52] U.S. Cl. ..... 72/379.2; 72/381; 72/383

[58] Field of Search ..... 72/297, 309, 381, 72/383, 384, 385, 403, 379.6, 379.2, 395

[56] References Cited

U.S. PATENT DOCUMENTS 3,461,711 8/1969 Ogilvie ..... 72/383

3,768,294 10/1973 Van Dijk ..... 72/395

FOREIGN PATENT DOCUMENTS 56-30033 3/1981 Japan ..... 72/381

4-28421 1/1992 Japan ..... 72/383

87/00095 1/1987 WIPO ..... 72/383

*Primary Examiner*—Lowell A. Larson

*Attorney, Agent, or Firm*—Bucknam and Archer

[57] ABSTRACT

There is disclosed a process and apparatus for producing reinforcement profiles on sheet metal panels wherein the profiles are obtained with the same metal sheet which constitutes the body of the finished shelf. The profiles are obtained by performing a drawing action so as to create a channel of inverted "C" shape and then performing a successive bending action capable of causing the reciprocal approach of the ends of its two parallel sides, obtaining, at the end of the operation, a shape in the form of an inverted isosceles triangle which constitutes the reinforcement profile.

7 Claims, 8 Drawing Sheets

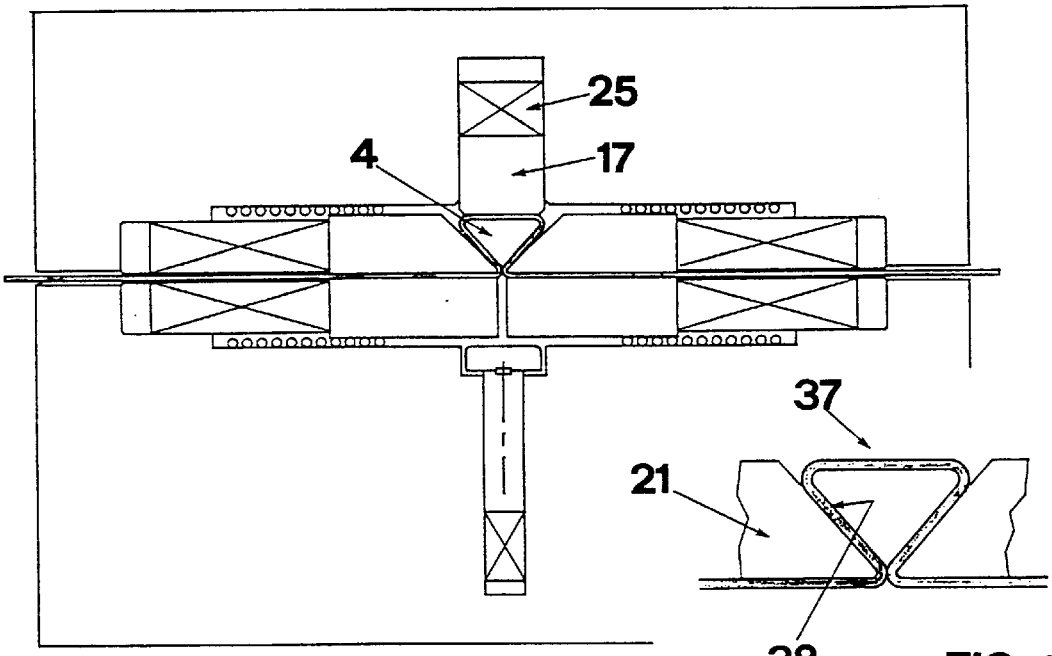
FIG. 11
FIG. 12
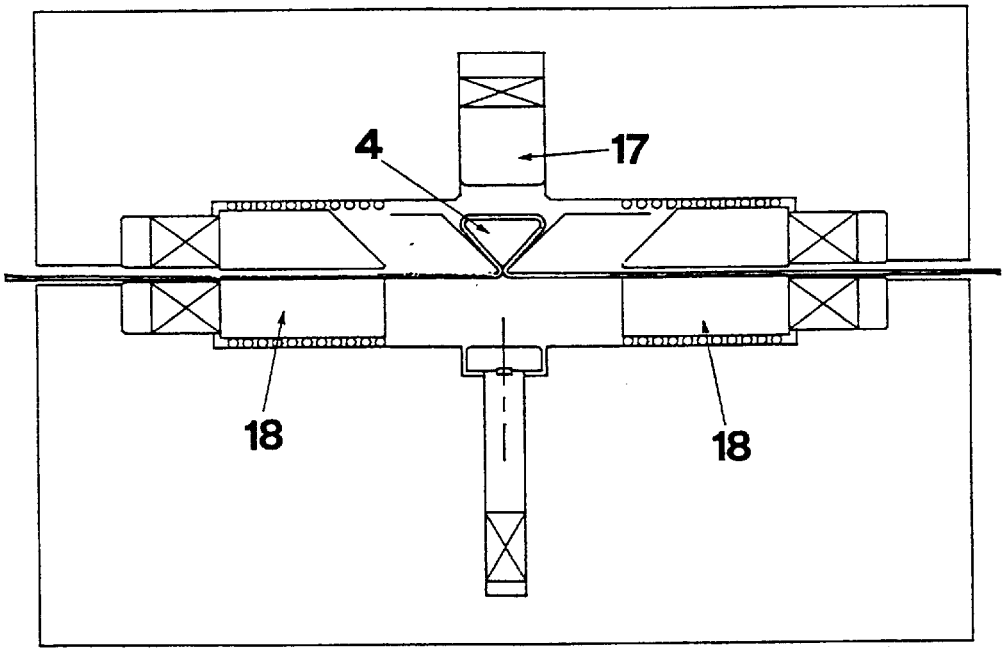
FIG. 13

PROCESS AND APPARTUS FOR PRODUCING REINFORCEMENT PROFILES ON SHEET METAL PANELS

SPECIFICATION

The present invention relates to a process and apparatus for producing reinforcement profiles on sheet metal panels wherein the profiles are obtained with portions of the same metal sheet constituting the sheet metal panel.

In the production of flat sheet metal panels, when such panels are of substantial dimensions, it becomes necessary to provide reinforcements capable of preventing these panels from potential binding or bulging.

Furthermore, when the flat sheet metal panels are used as shelves for shelving, it is necessary to provide reinforcements in order to strengthen the shelf itself and prevent it from sagging.

The reinforcements usually comprise sheet metal sections, as long as the largest dimension of the flat sheet metal panel and welded to the rear wall which is not visible, in the case of partitioning panels, or to the lower part of the bearing surface when the flat sheet metal panels are used as shelves for shelving and the like.

This type of shelving, so-called reinforced shelves, comprises at least two metal components, first, the box-type body, i.e. the metal sheet shaped so as to produce the shelf equipped with bent lateral edges and a second section, also of metal sheet, which is placed inside the box-type body.

The production or fabrication of a reinforced shelf therefore always requires the use of two different lines for cutting and bending, one for producing the box-type body and the other for producing the reinforcement sections, with the consequent need to also have available two distinct storage warehouses for each production line, another for the semi-finished product to be formed and yet another for storing the completed semi-finished product. The bending operation is followed by the assembly operation which consists of positioning one or more reinforcement sections inside the box-type body and finally the operation of welding the various components of the reinforced shelf.

According to the present state of technology, the above-mentioned operations for producing a reinforced shelf are automated, however, the operations still remain separate resulting in considerable time expenditure in passing from one operation to the other. Therefore, the current process for producing a reinforced shelf is characterized by low productivity.

The object of the present invention is to provide a working process, as well as a practical embodiment of an apparatus, capable of producing a reinforced shelf, i.e. equipped with a multiplicity of reinforcement sections, using a single component comprising a sheet of sheet metal. Such process eliminates completely the long and complicated phase of assembling at least two components and requires only one much reduced welding operation whereby two welded sections of a length equal to the extent of the profile of the shaped edge are produced.

The above object is achieved by performing a drawing operation on the metal sheet, which has already undergone the action of cutting the external edge, so as to create a hollow "C" shape developed along the entire length of the metal sheet itself. Subsequently a bending operation is performed which causes the approach of the ends of the two parallel sides of the "C" channel resulting finally in a new channel in the shape of an isosceles triangle or "inverted delta" which will constitute the final reinforcement section of the shelf.

Preferably, in the course of cutting the external profile of the metal sheet comprising the shelf, two "C" shaped recesses are also punched corresponding with the ends of the portion of the metal sheet which is then subjected to the drawing operation, and which occupy the entire width of the perimetrical part of the metal sheet intended to produce the bent lateral edges of the finished shelf. Thus, when the two successive deformation operations described above, the drawing operation first and then the bending operation, cause the reciprocal approach of the two portions of the metal sheet located outside the central portion subject to deformation, the two opposite edges of each "C" recess approach each other until they mate reciprocally thereby permitting the reciprocal welding thereof which is needed in order to give the final bent edge the appropriate strength.

A satisfactory embodiment of an apparatus capable of implementing the process described above comprises two opposing dies, one fixed and one moving, between which is positioned already cut or pre-cut metal sheet to be shaped. The fixed die is equipped with a punch which, projecting from the die itself, develops the drawing action to produce the "C" channel.

An innovative feature of the present invention is that of providing that each of the two dies is equipped with a pair of blank holders, arranged symmetrically with respect to the main axis of the dies which corresponds to the axis of the above mentioned drawing punch. Both the pairs of blank holders are adapted to slide on small rollers housed in seats formed on the body of the respective dies. In the course of the drawing operation performed by the punch which gradually projects from the fixed die, the pairs of blank holders move towards the central axis of the dies, having to accompany the reciprocal approach action which involves the two portions of metal sheet located laterally to the central portion of the same metal sheet and which, at that moment, is being subjected to the above-mentioned drawing action. When the drawing action is completed, the central punch withdraws whilst the pairs of blank holders continue their path of reciprocal approach.

Preferably, the two opposing blank holders, supported by the moving die and between which the inverted "C" shaped punched shape has been formed, have their sides, directed towards the center, pointed and accurately shaped to a point so as to form a wedge. By means of this wedge shape, the above-mentioned pointed sides of the blank holders perform a bending operation which causes the approach of the ends of the two parallel sides of the above-mentioned "C" channel, modifying its profile until it reaches the final form of a triangular shape and defined as an "inverted delta".

Finally, in order to prevent the possible spring back of the "inverted delta" channel, a flattening punch is placed in the moving die, which, at the end of the deformation operation, performs a flattening action on the base of the triangularly shaped channel profile thereby ensuring a perfect and complete approach at the vertex of the inclined sides of the channel.

The movement of the central punch, of the blank holders and of the flattening punch is achieved by means of bars of wedge-shaped profile which, by penetrating inside the body of the dies, cause the movement towards the center of the elements described above, said elements being kept in contact with the bars by means of biasing elements of contrast. The movement of the individual bars takes place by means of actuators integral with the fixed and moving dies of the apparatus.

When the flattening operation has also been completed and the flattening punch withdrawn, the pairs of blank holders release the hold on the metal sheet and move away from the punching zone, which allows the moving die to rise and to permit the removal of the shaped metal sheet and the introduction of a further one to be punched, which is positioned above the fixed die.

These and further features of the present invention will emerge in greater detail with consideration of the following description, given solely by way of illustrative and non-exhaustive example, with the aid of the accompanying drawings, in which:

FIG. 11 is a diagrammatic front view of the apparatus in the course of the flattening operation of the shaped form;

FIG. 12 is an enlarged detail view of the shaped form after the flattening operation;

FIG. 13 is a diagrammatic front view of the apparatus in the course of the withdrawal phase of the blank holders;

Figures 1, 2, 3:
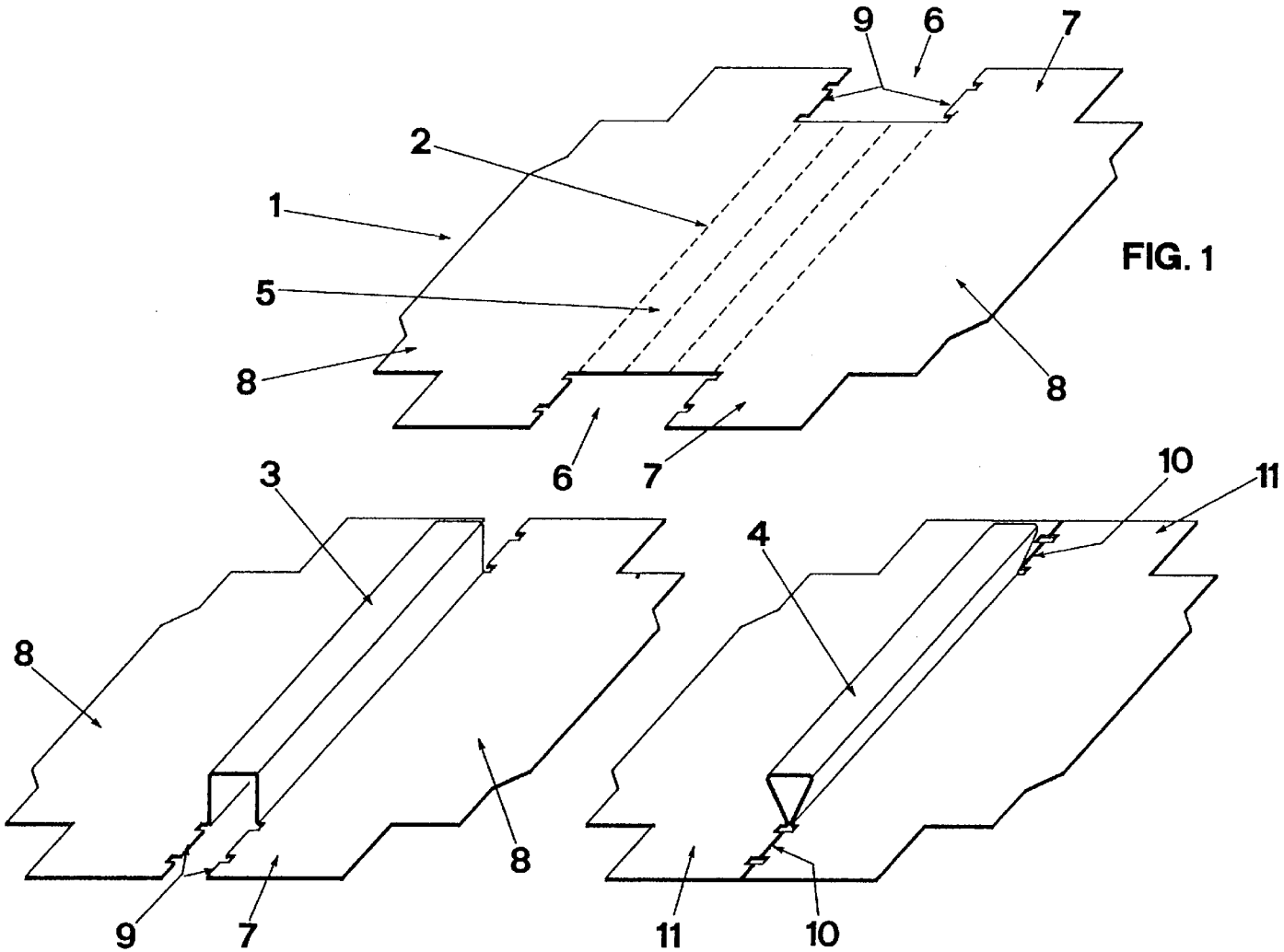
FIG. 1 is a perspective view of a shaped metal sheet prior to the bending operation.
FIG. 2 is a perspective view of the shaped metal sheet of FIG. 1 after the "C" drawing operation.
FIG. 3 is a perspective view of shaped metal sheet of FIG. 1 at the end of the bending operation.
Figure 15:
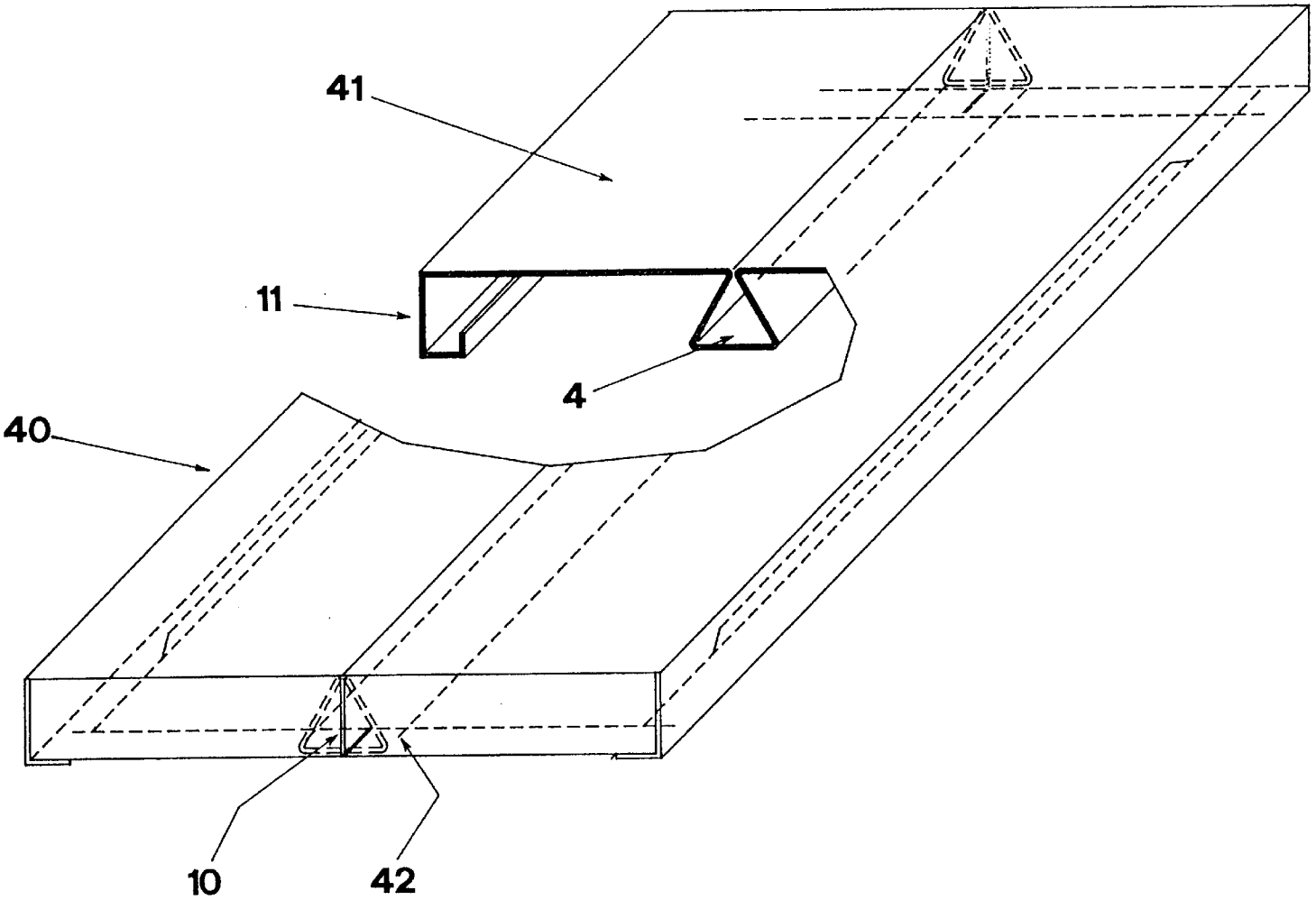
FIG. 15 is a perspective view of a completely bent reinforced shelf having a part thereof broken away.

Now turning to the drawings, there is shown in FIGS. 1, 2 and 3, a metal sheet 1, previously cut perimetrically so as to be able to obtain bent edges (as shown in FIG. 15) wherein the production of the reinforcement profile 4 undergoes two distinct deformation operations according to the four bending lines 2. The first deformation operation comprises a drawing operation which forms a "C" shaped hollow form 3 which extends over the entire length of the metal sheet. The second deformation operation comprises a bending operation of the two parallel edges of the above-mentioned channel 3 so as to produce a new and definitive form of the channel, causing it to assume a triangular, so-called "inverted delta" shape 4.

At the two ends of the central portion 5 of the metal sheet 1, two recesses 6 are formed which are as wide as the space occupied by the outermost bending lines 2 and of a depth equal to the development of the projections 7, which come to constitute the bent edge of the finished shelf. In the course of forming the channel 3 in the drawing operation, the lateral portions 8 of the metal sheet 1 approach reciprocally, reducing the width of the recesses 6, as clearly seen in FIG. 2. With the successive bending operation resulting in the shape 4, the lateral portions 8 approach each other further and at the end of the operation the opposite edges 9 of the recesses 6 are reciprocally adjacent. It is, therefore, possible to produce the weld 10 of the two adjacent edges 9 and thus to obtain a single projection 11 which will constitute the bent edge of the finished shelf.

Figure 4:
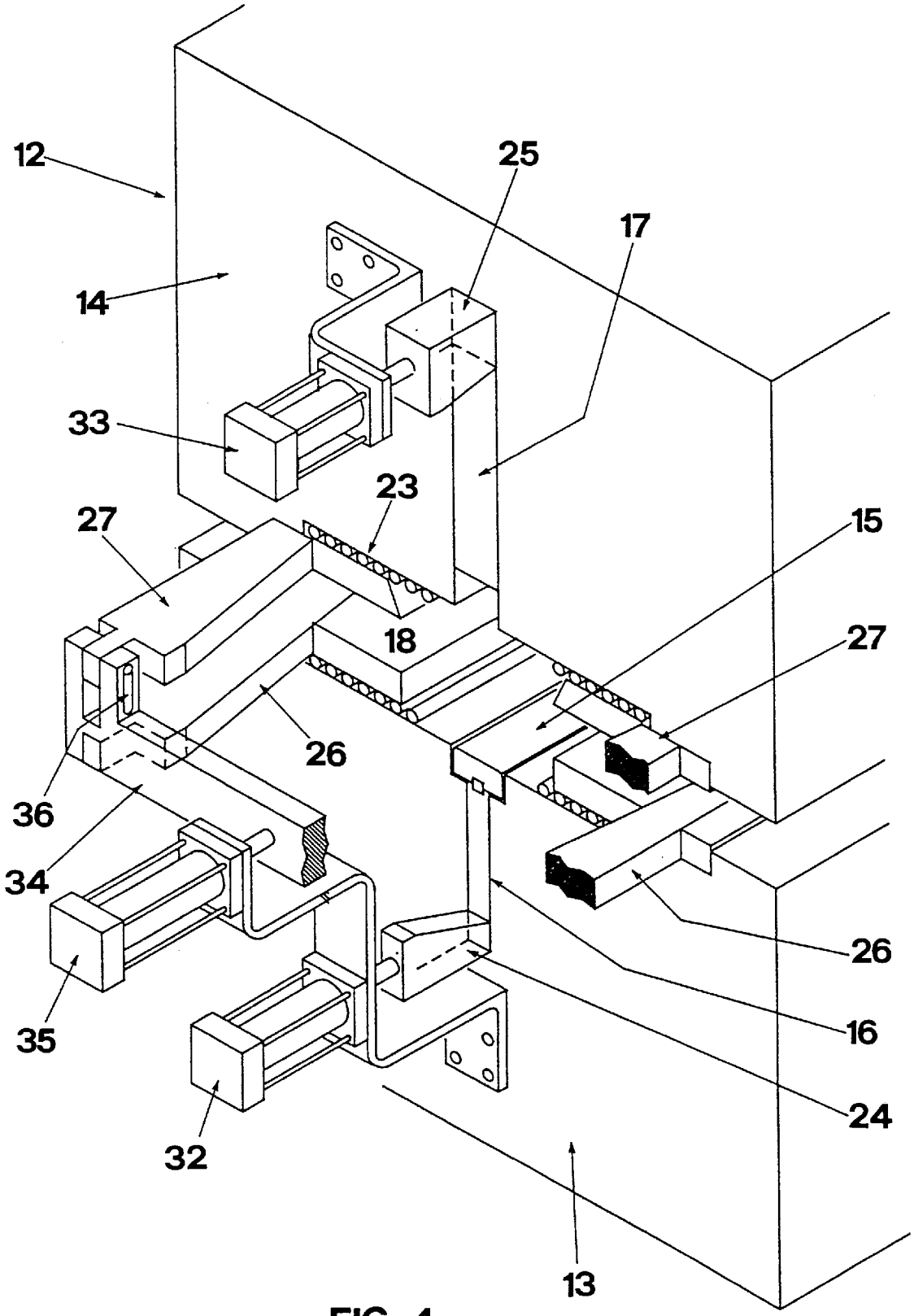
FIG. 4 is a diagrammatic perspective view of the bending apparatus, in the rest position with no metal sheet to work.
Figure 5:
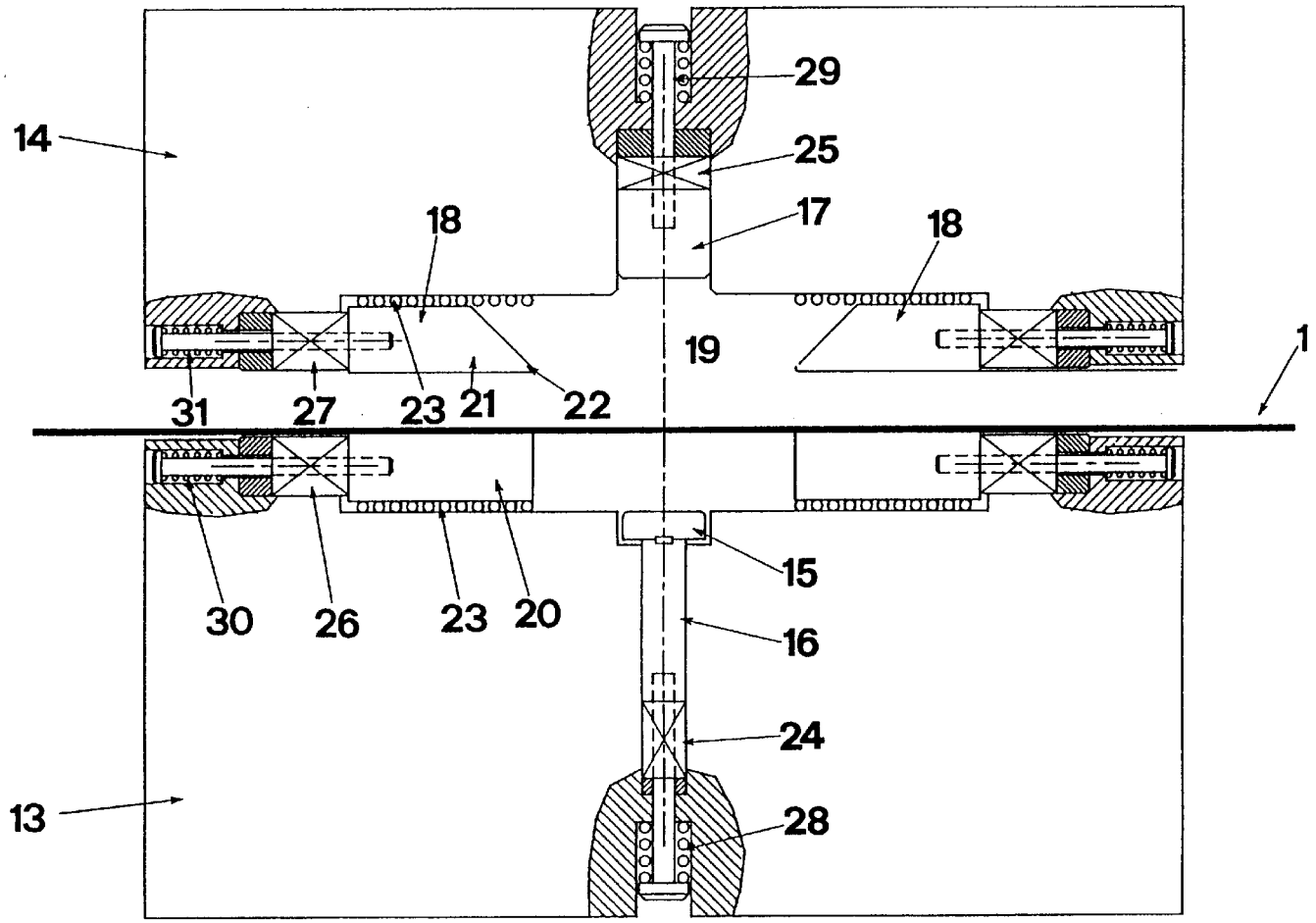
FIG. 5 is a diagrammatic front view of the apparatus of FIG. 4 in the rest position.

The apparatus 12 shown in FIGS. 4 and 5 which implements the drawing operation, to obtain the channel 3 and the bending operation to obtain the shape 4, comprises a fixed die 13 and a moving die 14, between which the metal sheet 1, previously cut according to the form shown in FIG. 1, is placed. The punch 16 is located in the fixed die 13 whilst the punch 17 is located in the moving die, said punches being coaxial and moving in opposing directions. Two pairs of blank holders 18, arranged symmetrically with respect to the main axis 19, are inserted between the above-mentioned dies 13 and 14. An element 20 of each pair of blank holders 18 is supported by the fixed die 13 whilst the other opposing element 21 is supported by the moving die 14.

In addition, the elements 21 have their side turned towards the central axis 19, pointed in the shape of a point so as to form a wedge-shaped end 22. Both the elements 20 and 21 of the blank holder 18 are adapted to slide on roller elements 23 located in seats formed in the corresponding dies.

The axial movement of the punches 16 and 17, and the rectilinear movement of the blank holders 18, is achieved by means of bars of variable or wedge-shaped profile which, penetrating inside the dies 13 and 14, move the various components towards the central zone. As clearly seen, bars 24 and 25 move punch 16 and punch 17 respectively whilst bars 26 and 27 move the elements 20 and 21 of each blank holder 18 respectively.

The contact of moving elements 16, 17, 20 and 21 with respective thrust bars 24, 25, 26 and 27 is achieved by means of biasing components, identified respectively with the reference numerals 28, 29, 30 and 31 and housed in seats formed in the respective dies 13 and 14.

As clearly seen in FIG. 4, the movement of the bars 24 and 25 takes place by means of the direct action of the actuators 32 and 33, respectively, which are integral with the fixed die 13 and the moving die 14, respectively. The bars 26 and 27 have their ends keyed to the crosspiece 34 on which the actuator 35 acts, which actuator is in its turn integral with the fixed die 13. The ends of the bars 27 slide in the slit 36 formed on the crosspiece 34, to enable the bars to follow the movement of the moving die 14 to which they are engaged with their other ends.

Figure 6:
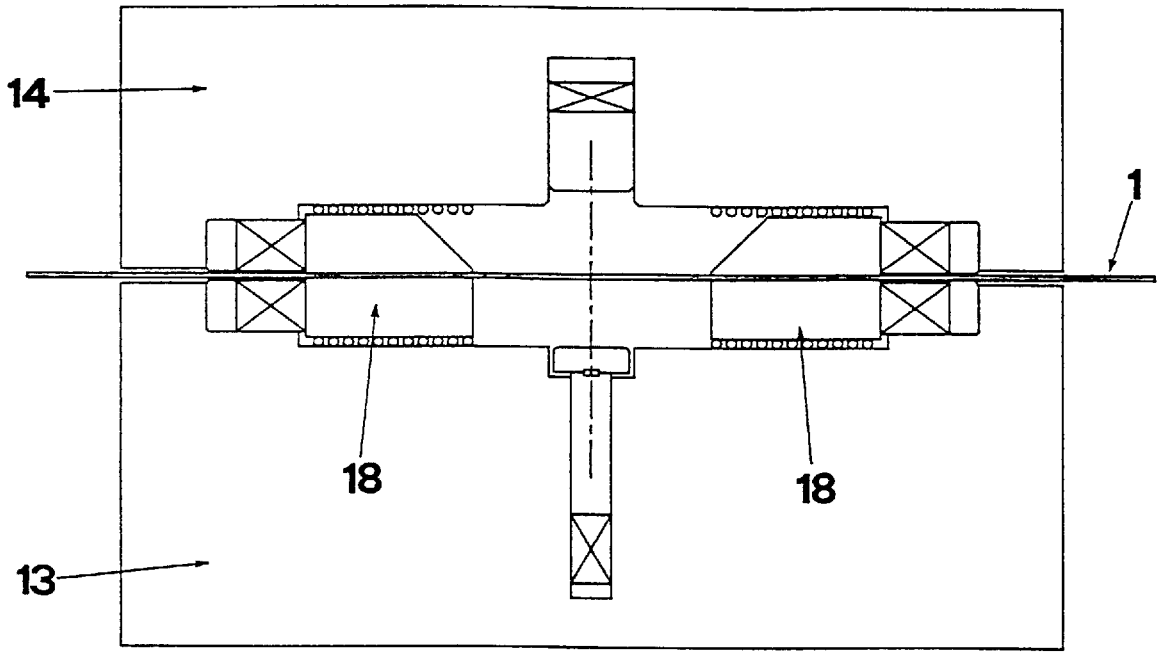
FIG. 6 is a diagrammatic front view of the apparatus in the course of the take-up phase of the blank holders.
Figure 7:
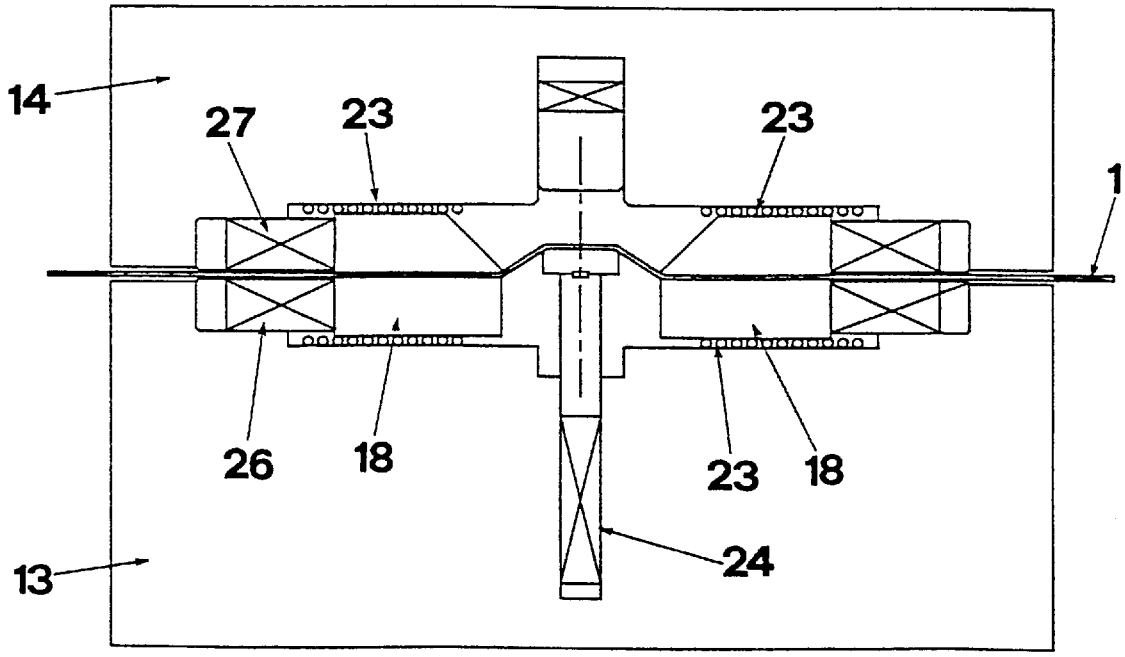
FIG. 7 is a diagrammatic front view of the apparatus in the course of the drawing operation.
Figure 8:
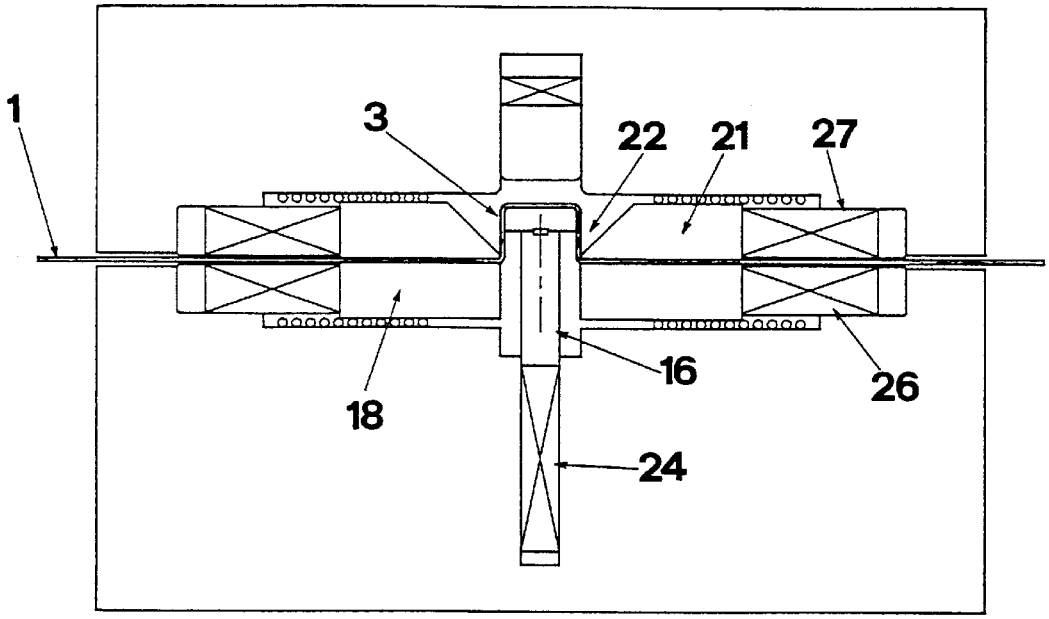
FIG. 8 is a diagrammatic front view of the apparatus at the end of the drawing operation.
Figure 9:
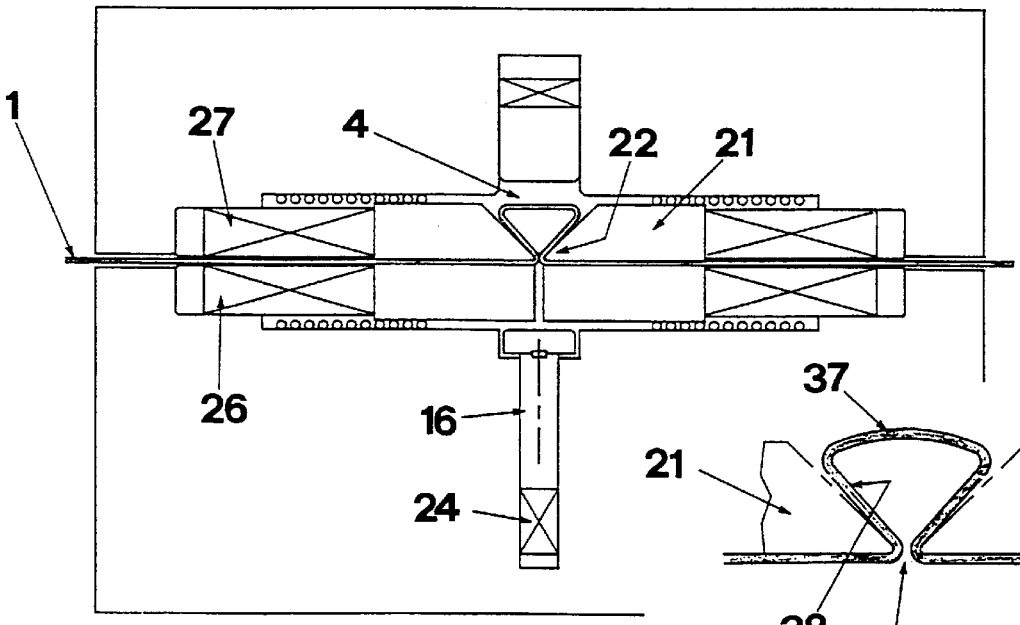
FIG. 9 is a diagrammatic front view of the apparatus at the end of the bending operation.

FIGS. 6 to 13 show the sequence of the working phases of the apparatus 12. In FIG. 6, the initial phase of the operation when pairs of blank holders 18 to couple the metal sheet 1 is shown. In FIG. 7 the punch 16, through the thrust action of the bar 24, leaves the fixed die 13 and initiates the drawing action of the metal sheet 1 and, at the same time, the movement towards the center by the blank holders 18 takes place. The blank holders accompany the return of the metal sheet 1 following the drawing operation on the metal sheet which brings the lateral portions 8 thereof towards the center. FIG. 8 shows the final phase of the drawing action w hen the punch 16 has reached the maximum extension, thus creating the inverted "C" shaped channel 3. The blank holders 18 have further approached one another and the pointed end 22 of the element 21 is in contact with the end of the opposing sides of the shape 3. FIG. 9 shows the final phase of the bending operation of the lateral edges of the shape 3, so as to obtain the successive shape 4 of triangular or "inverted delta" profile. The return of the punch 16 into the body of the die 13 enables the two pairs of blank holders 18 to continue in their movement of reciprocal approach by means of which, thanks to the pointed form of the elements 21, the bending of the lateral edges of the above-mentioned shape 3 is obtained until it is deformed into the shape 4.

Figure 10:
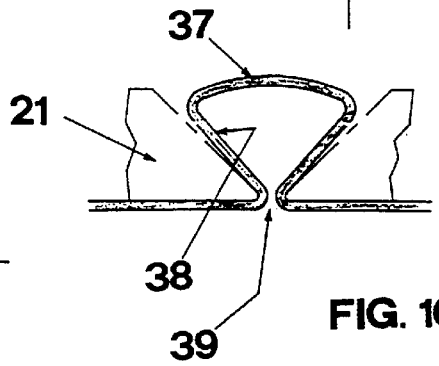
FIG. 10 is an enlarged detail view of the shaped form after the bending operation.

The detail illustrated in FIG. 10 shows how the shape 4 obtained with the process described above is not precisely an isosceles triangle because its base 37 is slightly rounded and also the two opposite edges 38 are not perfectly mating. A small interspace 39 remains between the edges 38, since, preferably, it is arranged to stop the elements 21 of the blank holders 18 so as to create the interspace 39. With this form of the shape 4, resembling an omega, if the blank holders are withdrawn, as a result of the spring back, the resulting shape tends to deform because the edges 38 tend to move outwardly back, considerably reducing the strength of that shape.

A further feature of the invention is that of providing a novel and further deformation action, having the purpose of giving the shape 4 a profile of perfectly triangular or "inverted delta" section so that the above-mentioned shape ensures the maximum strength and stiffness in the shelf. This feature consists in providing a flattening action on the base 37 of the shape 4 by means of a punch 17. With this operation the flattening of the above-mentioned base is created and furthermore also the perfect reciprocal approach of the two edges 38, resulting in the perfectly triangular shape as shown in FIG. 12.

FIG. 13 shows the retraction phase of the punch 17 and the release from the blank holders 18 of the shaped metal sheet 1 and their return to the rest position.

Figure 14:
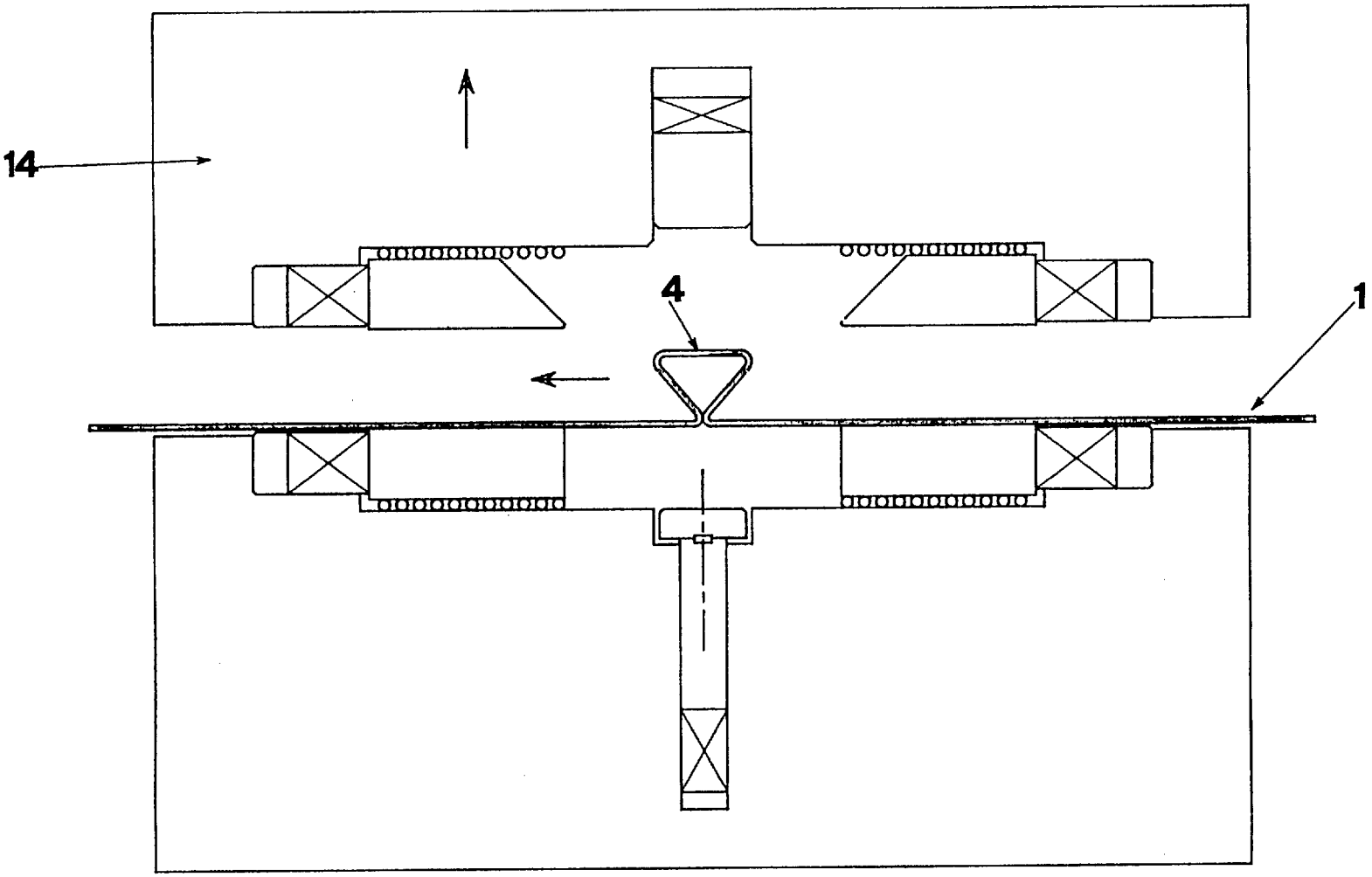
FIG. 14 is a diagrammatic front view of the apparatus in the course of the unloading phase of the shaped metal sheet.

At the end of the operation the raising of the moving die 14 above the shape 4 takes place so as to enable the shaped metal sheet 1 to be removed, as shown in FIG. 14.

Furthermore, the apparatus to which the present invention relates advantageously allows the possibility of producing reinforcement profiles 4, shaped like an "inverted delta", of various dimensions in a very speedy manner because it is simply necessary to replace the head 15 of the bottom punch 16 and to control, by means of a numerically controlled Programmable Logic Controller, the path of the actuators 32, 33 and 35.

FIG. 15 shows a finished, i.e. completely bent, shell 40, the advantages and features of the process to which the invention relates can be clearly seen therein. In particular, the use of a single sheet of sheet metal, the bearing surface 41 free from weld marks, the need to perform a limited welding bead 10 and the possibility of performing a second laser weld in the contact zone 42 between the flat end of the shaped profile 4 and the bent portion of the edge 11.

It is to be understood that the foregoing general and detailed descriptions are explanatory of the present invention and are not to be interpreted as restrictive of the scope of the following claims.

What is claimed is:

1. A process for forming a reinforced profile on a sheet metal panel, the shape of said reinforcement profile being in the form of an inverted isosceles triangle formed with the same sheet metal constituting the body of the finished sheet metal panel, said process comprising:

a) performing a drawing operation on said sheet metal panel to form a channel of inverted "C" shape;

b) performing a successive bending operation on said sheet metal panel to cause the reciprocal approach of the ends of the two sides of the channel of inverted "C" shape to form an inverted substantially isosceles triangular shape having a slightly rounded base side and two opposing sides defining a small interspace between the ends of said two opposing sides; and c) performing a successive flattening operation on the base of the substantially isosceles triangular shape so that the small interspace between the ends of said two opposing sides of the substantially isosceles triangular shape is eliminated.

2. The process as defined in claim 1, wherein the finished sheet metal panel includes at ends thereof between which is the reinforcement profile bent edges having a width and the sheet metal panel prior to the operations of the process includes two recesses located at the ends thereof corresponding to the bent edges of the finished panel, the recesses having a depth equal to the width of the bent edges so that the opposing edges of the recesses mate reciprocally following said bending operation so as to permit welding thereof and formation of opposing projections on said sheet metal panel to be bent to form the bent edges of the finished sheet metal panel.

3. An apparatus for forming a reinforcement profile on a sheet metal panel, the shape of said reinforcement profile being in the form of an inverted isosceles triangle formed with the same sheet metal constituting the body of the finished sheet metal panel, said apparatus comprising:

a fixed die and an opposing movable die having a common central axis, the sheet metal panel being positioned between the dies;

a first punch arranged in the fixed die and having an interchangeable head for performing a drawing operation on said sheet metal panel;

a second punch arranged in the movable die and being coaxial with said first punch, said first and second punches moving in opposing directions, said second punch performing a flattening operation; and two pairs of blank holders arranged symmetrically with respect to said central axis and arranged between said first and second dies, each blank holder comprising a first element supported by the fixed die and a second opposing element supported by the movable die, each of said second elements having its side facing the central axis wedge shaped and terminating in a point;

whereby the flattening operation of said second punch is performed on the base of a triangular shaped profile formed by the reciprocal movement of said blank holders whereby ends of the two sides of an inverted "C" shaped profile subsequently shaped into an isosceles triangular shape are brought into contact.

4. The apparatus as defined in claim 3, which further comprises:

respective thrust bars of variable profile which act on said first and second punches and said two pairs of blank holders respectively, to cause movement thereof;

biasing means for maintaining reciprocal contact between said first and second punches and said two pairs of blank holders and their respective thrust bars;

roller elements for providing sliding movement of said first and second elements of said two pairs of blank holders; and activators of fixed or variable path controlling the movements of said thrust bars and in turn being controlled by a Programmable Logic Controller.

5. The apparatus as defined in claim 4, wherein following the coupling of the blank holders to the sheet metal panel, the first punch exits from the fixed die as a result of the thrust action of the respective thrust bar forming a drawn inverted "C" shape in the sheet metal panel, said blank holders moving towards the central axis accompanying the reciprocal movements of the lateral portions of the sheet metal panel resulting from the deformation thereof by said first punch.

6. The apparatus as defined in claim 5, wherein, upon the return of said first punch into said fixed die, the reciprocal movement of said blank holders continues forming the reinforcement profile in the shape of an inverted isosceles triangle.

7. The apparatus as defined in claim 7, wherein upon retraction of said second punch into said movable die and the release and retraction of said blank holders and the raising of said movable die permits the withdrawal of the sheet metal panel having the reinforcement profile in the shape of an isosceles triangle.

* * * * *